United States Patent [19]

Barcikowski et al.

[11] 4,244,074

[45] Jan. 13, 1981

[54] PAD APPLICATOR

[75] Inventors: Donna M. Barcikowski, Natrona Heights; Rodger G. Temple, Gibsonia; James E. Jones, Lower Burrell; Jerome A. Seiner, Pittsburgh, all of Pa.

[73] Assignee: PPG Industries, Inc., Pittsburgh, Pa.

[21] Appl. No.: 952,168

[22] Filed: Oct. 17, 1978

[51] Int. Cl.[3] ..... A46B 15/00

[52] U.S. Cl. ..... 15/114; 15/118

[58] Field of Search ..... 15/118–120, 15/114–117, 106, 210 R, 144 A, 145; 401/9, 261

[56] References Cited

U.S. PATENT DOCUMENTS

| | | | |
|---|---|---|---|
| 2,907,061 | 10/1969 | Whalen | 15/114 |
| 2,936,473 | 5/1960 | Karnes | 15/114 |
| 3,085,270 | 4/1963 | Vosbikian et al. | 15/114 |
| 3,388,415 | 6/1968 | Warner et al. . | |
| 3,629,894 | 12/1971 | Stefany | 15/146 |
| 3,638,270 | 2/1972 | Schlegel et al. | 15/114 |
| 3,656,202 | 4/1972 | Paton | 15/118 |
| 3,722,019 | 3/1973 | Magnien | 15/114 |

*Primary Examiner*—John M. Jillions
*Assistant Examiner*—Timothy F. Simone
*Attorney, Agent, or Firm*—George D. Morris

[57] ABSTRACT

A pad applicator suitable for applying paint comprises a handle, an exterior applying layer and a resilient cushion interposed between the handle and the exterior applying layer. The exterior applying layer comprises two working zones, the first having a pile of generally erect bristle-like fibers and the second having a pile of soft, fleecy fibers.

49 Claims, 13 Drawing Figures

FIG. 6
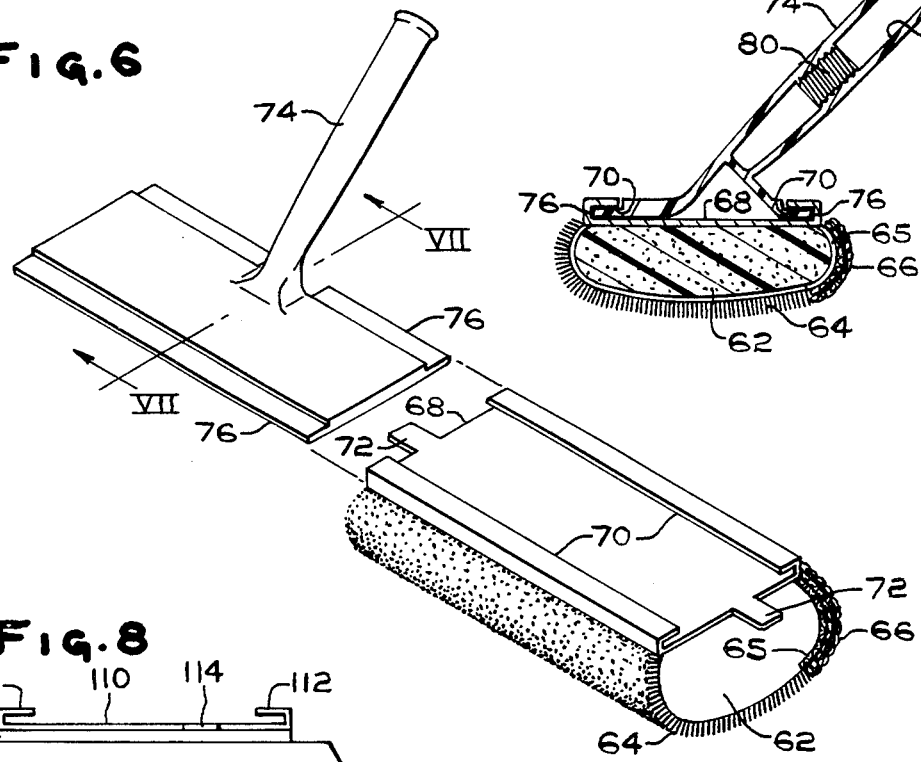
FIG. 7
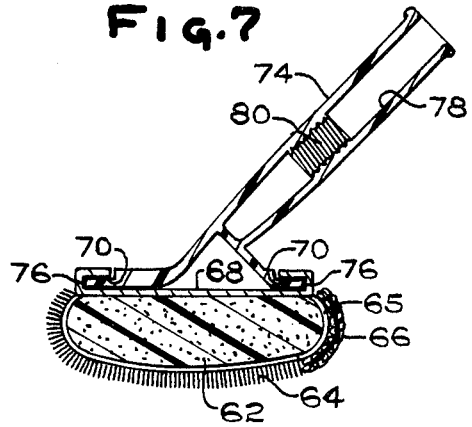
FIG. 8
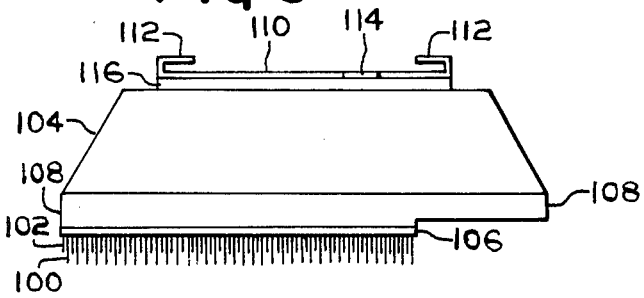
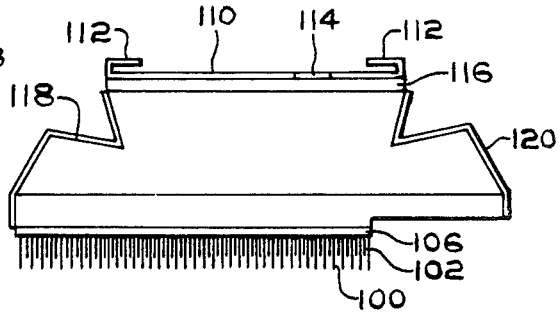
FIG. 9
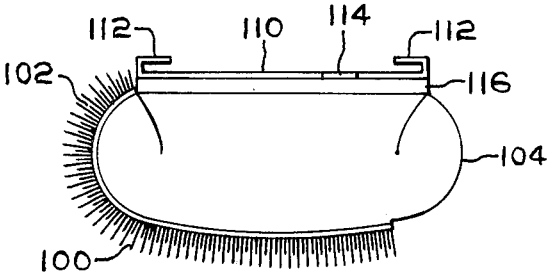
FIG. 10
FIG. 11
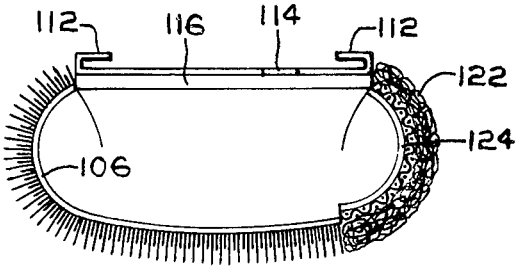

FIG. 12
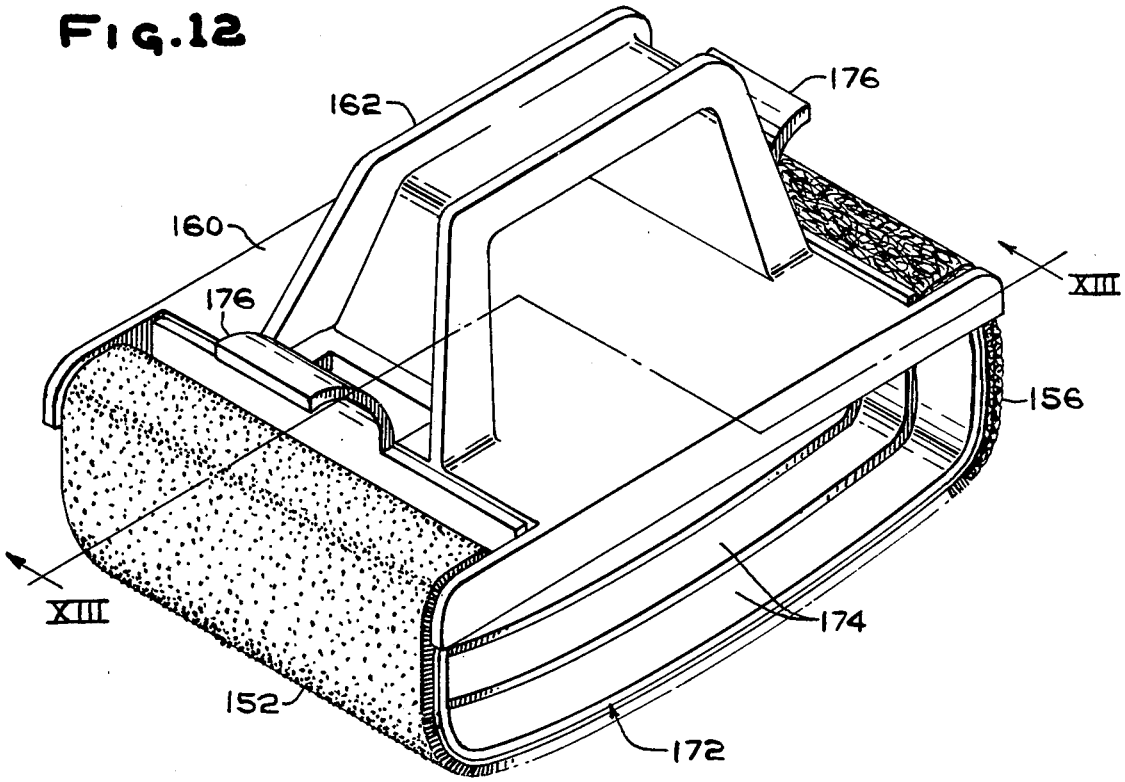
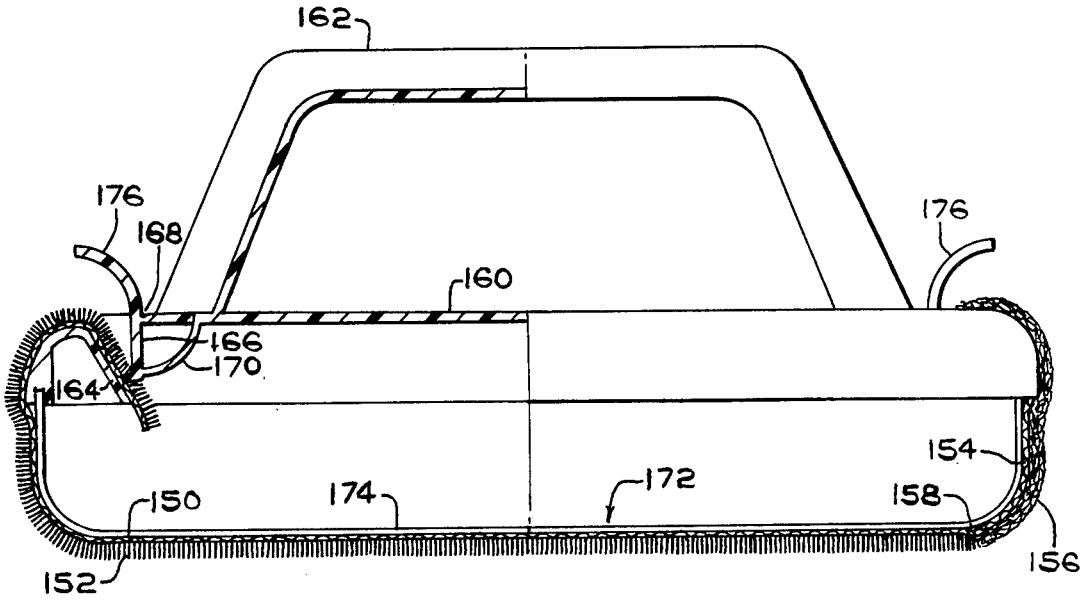
FIG. 13

PAD APPLICATOR

When pad applicators are used to apply paints and materials having viscosities commonly associated with paints, a major problem has been dripping of the material from the applicator. This is particularly a problem when application is made to vertical surfaces such as walls. The present invention serves to reduce or, in many cases, even eliminate the dripping associated with the use of a pad applicator.

For a better understanding of the invention, reference may be made to the drawings wherein like numerals refer to like parts in which:

FIG. 6 shows an exploded view of an embodiment of a pad applicator of the invention;

FIG. 7 shows a sectional view taken along the line VII-VII of FIG. 6 after assembly of the applicator;

FIGS. 8–11 show sequentially a manner in which the applicator pad of the applicator of FIG. 6 may be produced.

FIG. 12 shows diagrammatically a further embodiment of a pad applicator of the invention; and FIG. 13 shows a partial sectional view taken along the line XIII—XIII of FIG. 12.

Figure 1:
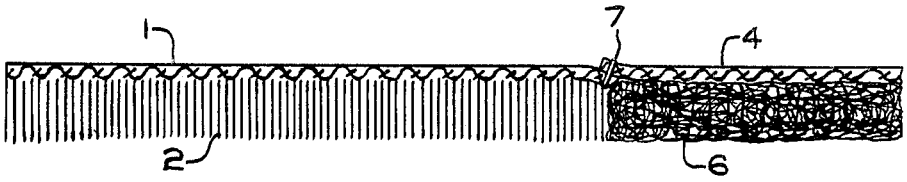
FIG. 1 shows diagrammatically in cross section an embodiment of an applicator cover of the invention.

The pad applicator of the invention may advantageously comprise a handle, an exterior applying layer and a resilient cushion interposed between the handle and the exterior applying layer. The exterior applying layer comprises a first working zone having a pile comprising a first set of generally erect bristle-like fibers and a second working zone having a pile of soft, fleecy fibers. The exterior surface of the first working zone constitutes from about 30 to about 95 percent of the total exterior surface area of the exterior applying layer. The exterior surface of the second working zone constitutes from about 5 to about 70 percent of the total exterior surface area of the exterior applying layer.

The first working zone may comprise a fabric having one or more sets of piles of generally erect bristle-like fibers. Such pile fabrics are themselves well known in the art and may be produced by conventional means. The fabric may be woven, knitted or nonwoven. Exemplary pile fabrics may be produced by cutting the loops of a pile weave or pile knit, by cutting the yarn that holds the two cloths of a double-cloth weave together, by needling a woven, knitted or nonwoven fabric, by needling a batt of fibers through a woven, knitted or nonwoven fabric, by napping or teaseling a woven, knitted or nonwoven fabric or by flocking an adhesive-coated woven, knitted or nonwoven fabric. The pile of the first working zone may alternatively be affixed to backings other than fabrics, such as for example, paper, metal foil, natural or synthetic sponge material or polymeric films. Needling of a batt of fibers through the backing or flocking are the usual methods for preparing such articles. The pile of the first working zone may be flocked directly onto an adhesive coating applied to the resilient cushion of the applicator pad. The pile may also be produced by needling a batt of fibers through the resilient cushion of the applicator pad. Animal pelts having a pile of bristle-like fibers as for example horsehair pelts and the like may be used. In all cases the pile may be sheared when it is desired to adjust the fiber length. Flocking is usually accomplished in an electrostatic field to align the fibers. These methods are illustrative only; substantially any method which produces a pile of generally erect bristle-like fibers may be used. All, a portion or none of the bristle-like fibers may be flagged as desired. The pile of the first working zone may additionally comprise a second set, or even more sets of generally erect bristle-like fibers which are shorter than and distributed among the fibers of the first set. This is most easily accomplished when the fibers are applied by flocking techniques.

The pile of the second working zone is one of soft, fleecy fibers. This pile is bulky and deep with the fibers more or less matted as is characteristic of lambswool. Indeed, animal pelts having a pile of soft, fleecy fibers, such as for example lambswool pelts and the like, may be used. The second working zone may comprise a fabric having such a pile of fibers. The fabric may be woven, knitted or nonwoven. Exemplary pile fabrics may be produced by needling a woven, knitted or nonwoven fabric, by needling a batt of fibers through a woven, knitted or nonwoven fabric or by napping or teaseling a woven, knitted or nonwoven fabric. The pile of the second working zone may alternatively be affixed to backings other than fabrics, such as for example, paper, metal foils, natural or synthetic sponge materials or polymeric films. Needling a batt of fibers through the backing is the usual method for preparing such articles. In all cases the pile may be sheared when it is desired to adjust the pile height. These methods are illustrative only; substantially any method which produces a material having a pile of soft, fleecy fibers may be used.

The effective height of the pile of the second working zone may be at least as great as or slightly less than the height of the first set of generally erect bristle-like fibers of the first working zone. It is preferred that the effective height of the pile of the second working zone be the same as or slightly greater than the height of the first set of generally erect bristle-like fibers. Although considerable latitude in varying the relative pile heights may be employed, the effective height of the pile of the second working zone should not be so much less than the height of the first set of generally erect bristle-like fibers that it is ineffective in reducing dripping, nor should it be so much greater that the bristle-like fibers are rendered ineffective in applying paint. As used in the specification and claims, the term "effective height", when referenced to the pile of the second working zone, refers to the height of the fleece, rather than to the length of the individual fibers constituting the fleece. Usually the length of the individual fibers, or at least of substantial proportions of them, is greater than the effective height of the fleece itself.

The height of the first set of generally erect bristle-like fibers of the first working zone is subject to wide variation. It should not be so great as to cause the fibers to loose their bristle-like qualities nor should it be so small that the fibers cease to effectively hold and apply paint. The height of the first set of generally erect bristle-like fibers is usually in the range of from about 0.1 to about 4 centimeters. From about 0.2 centimeter to about 1 centimeter is preferred.

In general, the bristle-like fibers should flex upon application of forces usually applied when using pad applicators, but they should be resilient enough to substantially return to the generally erect position upon removal of the applied force. Usually, such generally erect fibers are within about forty-five degrees of the normal to the backing.

The bristle-like fibers and the fibers of the fleece may be animal fibers, vegetable fibers or synthetic fibers. Exemplary of synthetic fibers are those of polyester or polyamide.

The exterior surface of the first working zone constitutes from about 30 to about 95 percent of the total exterior surface area of the exterior applying layer. Generally it constitutes from about 50 to about 90 percent of such total exterior surface area. From about 60 to about 80 percent is preferred.

The exterior surface of the second working zone constitutes from about 5 to about 70 percent of the total exterior surface area of the exterior applying layer. Usually it constitutes from about 10 to about 50 percent of such total exterior surface area. From about 20 to about 40 percent is preferred.

The exterior surface layer may assume any shape useful in pad applicators. Usually the exterior applying layer comprises a front edge portion, a rear edge portion and two side edge portions. It is preferred that the rear edge portion comprises at least a part of the second working zone.

The present invention contemplates an applicator cover comprising an external applying layer, described above. The applicator cover may, if desired, additionally comprise a flexible barrier layer affixed to the exterior applying layer on a surface thereof opposite from either the exterior surface of the first working zone or the exterior surface of the second working zone, but it is preferred that the barrier layer, when used, be affixed to the exterior applying layer on both a surface opposite from the exterior surface of the first working zone and a surface opposite from the exterior surface of the second working zone. The purpose of the barrier layer is to prevent paint or other material being applied from migrating into the resilient cushion of the applicator or applicator pad. Many different materials may be used as the barrier layer. Illustrative materials include polymeric films, such as films of poly(ethylene terephthalate), polyethylene, polypropylene, poly(vinyl chloride), poly(vinylidene chloride), copolymers of vinyl chloride and vinylidene chloride, poly(tetrafluoroethylene) and regenerated cellulose. Other materials include paper, waxed paper, metal foil such as aluminum foil and even a layer of sealant or adhesive which suitably blocks migration of the material being applied. The barrier layer may be affixed to the exterior applying layer by various means. The usual way is by the use of an adhesive. Other means include the use of stitching, staples, clamps, snaps, rivits or other mechanical fasteners.

The present invention also contemplates an applicator pad having a resilient cushion and an exterior applying layer heretofore described, affixed to the cushion.

Examples of suitable resilient cushions are those of flexible porous materials such as flexible polymeric foam. The foam may be either open celled, closed celled or a combination of the two. Flexible polyurethane foam, flexible polyethylene foam, flexible regenerated cellulose foam and flexible sponge rubber are all satisfactory. The resilient cushion may be composed of a batt of fibers, which fibers are usually, but not necessarily crimped. The batt of fibers is generally enclosed by the applicator pad on one side and a cover fabric on the other. In still another embodiment, the resilient cushion may be resilient springs, such as those fabricated from plastic or metal.

The exterior applying layer may be affixed to the resilient cushion by any suitable means, such as, for example, adhesive, stitching, rivits, staples, clamps, snaps, needled fibers, Velcro hook and loop fasteners and the like.

The applicator pad may include means for attaching the applicator pad to a handle. Such means may be affixed to the resilient cushion by adhesive, screws, rivits, staples, clamps, snaps, or other such fasteners. Usually the applicator pad includes a base affixed to the resilient cushion, which base includes means for attaching the applicator pad to a handle. The base may be of any suitable material of construction such as metal, wood, cardboard, plastic or the like. The base may be affixed to the resilient cushion by adhesive or mechanical fasteners such as those described above. The means for attaching the applicator pad to a handle may be grooves, slots, holes, snaps, clips or other means which functionally cooperate with the handle.

The invention further contemplates a pad applicator comprising a handle, an exterior applying layer as hereinabove described, and a resilient cushion, also heretofore described, interposed between the handle and the exterior applying layer. The resilient cushion may be affixed to the handle, to the exterior applying layer, to both or to neither. The usual means of affixing is an adhesive, although mechanical fasteners may be used.

Although the exterior surface of the exterior applying layer may be planar, at least a part of such surface is usually sloped upward. Usually, the sloped portions are adjacent to the periphery, although the entire surface may be sloped if desired.

In the preferred embodiment, the exterior applying layer of the pad applicator comprises a front edge portion, a rear edge portion and two side edge portions. Typically, the shape of the exterior applying layer is rectangular. Any or all of these edge portions may be sloped upward. Most often the front edge portion, the rear edge portion or both are sloped upward. It is especially preferred that the rear edge portion comprise at least a part of the second working zone. Most often the rear one-third of the exterior applying layer contains at least half of the second working zone.

Referring now in detail to the drawings, there is shown diagrammatically in FIG. 1 an applicator cover comprising woven fabric 1 having a pile 2 of generally erect bristle-like fibers and further comprising woven fabric 4 having a pile 6 of soft, fleecy fibers. Fabric 1 and fabric 4 are attached by stitches 7.

Figure 2:
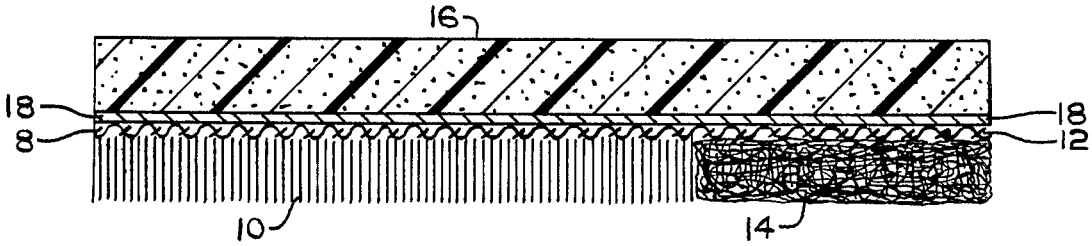
FIGS. 2–5 show diagrammatically in cross section various embodiments of applicator pads of the invention.

FIG. 2 shows diagrammatically an applicator pad having an exterior applying layer comprising woven fabric 8 having a pile 10 of generally erect bristle-like fibers and woven fabric 12 having a pile 14 of soft, fleecy fibers. Fabric 8 and fabric 12 are affixed to resilient cushion 16 of flexible polymeric foam by adhesive 18.

Figure 3:
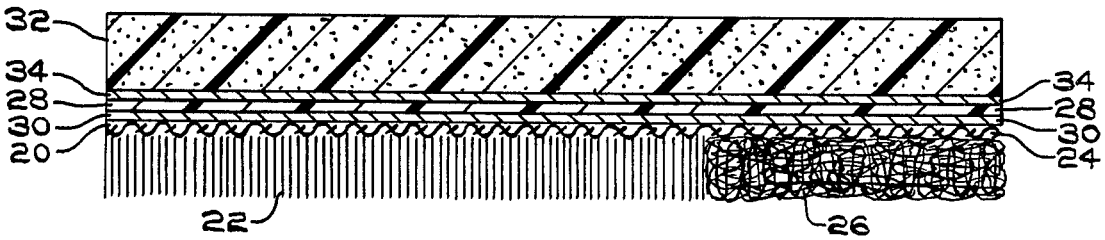

FIG. 3 shows diagrammatically an applicator pad having a flexible barrier layer of flexible polymeric film interposed between the resilient cushion and the exterior applying layer. In this embodiment, woven fabric 20 having a pile 22 of generally erect bristle-like fibers and woven fabric 24 having a pile 26 of soft, fleecy fibers are affixed to flexible barrier layer 28 by adhesive 30. Flexible barrier layer 28 is affixed to resilient cushion 32 by adhesive 34.

Figure 4:
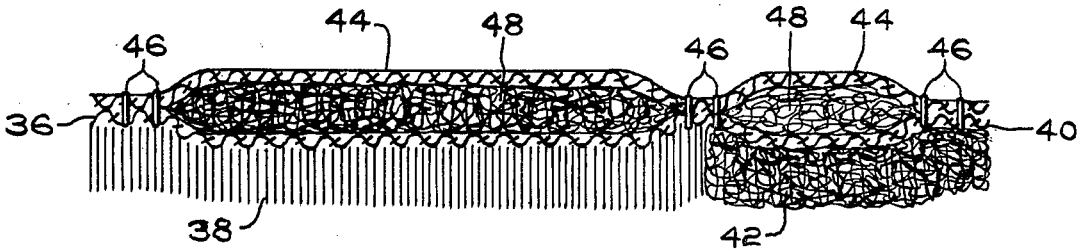

FIG. 4 shows diagrammatically an applicator pad comprising woven fabric 36 having a pile 38 of generally erect bristle-like fibers and woven fabric 40 having a pile 42 of soft, fleecy fibers. Fabric 36 and fabric 40 are stitched along the edges to woven backing fabric 44 by threads 46 with a resilient batt 48 of crimped polymeric fibers interposed between fabric 44 and fabrics 36 and 40.

Figure 5:
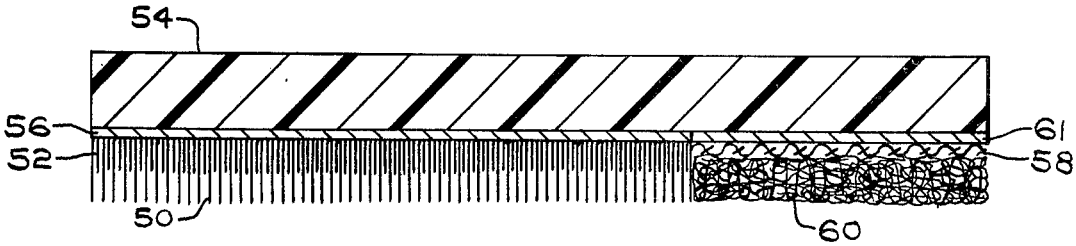

FIG. 5 illustrates diagrammatically an applicator pad having a first set 50 of generally erect bristle-like fibers and a second set 52 of shorter generally erect bristle-like fibers flocked onto adhesive 56 applied to resilient cushion 54 of flexible polymeric foam. Woven fabric 58 having a pile 60 of soft, fleecy fibers is also affixed to resilient cushion 54 by adhesive 61.

The pad applicator illustrated in FIGS. 6 and 7 includes an applicator pad having a resilient cushion 62 of flexible polymeric foam to which there are affixed by adhesive, not shown, two sets 64 of flocked generally erect bristle-like fibers and to the rear edge portion a woven fabric 65 having a pile 66 of soft, fleecy fibers. Attached to resilient cushion 62 by adhesive, not shown, is steel base 68 including channels 70 and tabs 72. Handle 74 includes tongues 76 which engage channels 70. Upon assembly of the applicator pad and handle 74, tabs 72 may be folded to lock handle 74 into place. As shown in FIG. 7, the handle is hollow as indicated at 78 and internally threaded at 80 capable of receiving an extension pole, not shown.

FIGS. 8–11 show diagrammatically one way in which the applicator pad of FIG. 6 may be fabricated and will be used to describe a particular embodiment. An applicator pad manufactured by Padco of Minneapolis, Minnesota has a 11½ centimeter by 23 centimeter rectangular applying layer. The exterior applying layer consists of a first set 100 of 18 denier trilobal nylon fibers having a length of about 0.51 centimeter and a second set 102 of 15 denier trilobal nylon fibers having a length of about 0.23 centimeter both of which have been flocked onto adhesive 106 applied to flexible foam resilient cushion 104. The fibers of both sets are bristle-like and generally erect. The resilient cushion is generally in the form of the frustum of a pyramid wherein a portion near the large base has been removed to leave vertical sides 108. The thickness of the resilient cushion is about 2.8 centimeters. The smaller, upper base is a 20.2 centimeter by 8.6 centimeter rectangle. A steel base 110 having channels 112 and tabs 114 is centrally affixed to the upper base by adhesive 116. The first step in producing the applicator pad is shown in FIG. 8 wherein a strip of the exterior applying layer about 2.5 centimeters wide has been removed, together with the adjacent adhesive, from the resilient cushion along the rear edge. Notches 118 are then cut in the resilient cushion and covered with contact adhesive 120 as shown in FIG. 9. The excess foam is compressed inwardly and the lower sides of the foam are adhered to the upper sides as shown in FIG. 10. A 2.5 centimeter wide strip of roller cover fabric 122, manufactured by Roller Fabrics, Inc. of Milwaukee, Wisconsin, which fabric has a polyester backing and a soft fleecy pile of 3 denier Kodel polyester circular fibers, is affixed to the rear edge portion of the resilient cushion by adhesive 124 as shown in FIG. 11. The effective height of the pile is about 0.6 centimeters. The lateral edges are trimed to form sloped sides as shown in FIG. 6.

FIGS. 12 and 13 show a pad applicator having an applicator pad comprising woven fabric 150 having a pile 152 of generally erect bristle-like fibers and woven fabric 154 having a pile 156 of soft, fleecy fibers. Fabric 150 and fabric 154 are joined together by stitching 158. Base 160 is of molded plastic and includes handle 162, retainer plates 164 and ratchets 166 which are able to rotate around pivot 168 and are urged toward their respective retainer plates 164 by springs 170. Attached to base 160 is resilient cushion 172 formed from sheet plastic and containing plastic springs 174. The applicator pad is held in the general proximity of springs 174 by ratchets 166 and retainer plates engaging edges of the applicator pad. Tabs 176 are provided for releasing the applicator pad from the base.

The pad applicator of the invention is particularly useful in applying paint to surfaces. It is especially useful in applying semi-solid water-based coating disclosed in Application Ser. No. 912,807, filed June 5, 1978. The pad applicator is also useful in applying other materials, such as waxes, polishes, shelacs and varnishes.

We claim:

1. An applicator cover comprising an exterior applying layer wherein:

a. said exterior applying layer comprises
   (1) a first working zone having a pile comprising a first set of generally erect bristle-like fibers, and
   (2) a second working zone having a pile of soft, fleecy fibers;
b. the exterior surface of said first working zone constitutes from about 30 to about 95 percent of the total exterior surface area of said exterior applying layer;
c. the exterior surface of said second working zone constitutes from about 5 to about 70 percent of the total exterior surface of said exterior applying layer; and
d. the rear one-third of said exterior applying layer contains at least half of said second working zone.

2. The applicator cover of claim 1 wherein said first working zone is a fabric having a flocked pile.

3. The applicator cover of claim 1 wherein the effective height of said pile of said second working zone is at least as great as the height of said first set of generally erect bristle-like fibers.

4. The applicator cover of claim 1 wherein the effective height of said pile of said second working zone is slightly less than the height of said first set of generally erect bristle-like fibers.

5. The applicator cover of claim 1 wherein said pile of said first working zone additionally comprises a second set of generally erect bristle-like fibers which are shorter than and distributed among said fibers of said first set.

6. The applicator cover of claim 1 additionally comprising a flexible barrier layer affixed to said exterior applying layer on a surface thereof opposite from said exterior surface of said first working zone.

7. The applicator cover of claim 1 additionally comprising a flexible barrier layer affixed to said exterior applying layer on a surface thereof opposite from said exterior surface of said second working zone.

8. The applicator cover of claim 1 additionally comprising a flexible barrier layer affixed to said exterior applying layer on a. a surface thereof opposite from said exterior surface of said first working zone, and
b. a surface thereof opposite from said exterior surface of said second working zone.

9. The applicator cover of claim 8 wherein said flexible barrier layer comprises a polymeric film.

10. The applicator cover of claim 1 wherein said exterior applying layer comprises a front edge portion, a rear edge portion and two side edge portions.

11. The applicator cover of claim 10 wherein said rear edge portion comprises at least a part of said second working layer.

12. An applicator pad comprising
a. a resilient cushion; and
b. an exterior applying layer affixed to said cushion; wherein
c. said exterior applying layer comprises
(1) a first working zone having a pile comprising a first set of generally erect bristle-like fibers, and
(2) a second working zone having a pile of soft, fleecy fibers;
d. the exterior surface of said first working zone constitutes from about 30 to about 95 percent of the total exterior surface area of said exterior applying layer;
e. the exterior surface of said second working zone constitutes from about 5 to about 70 percent of the total exterior surface area of said exterior applying layer; and
f. the rear one-third of said exterior applying layer contains at least half of said second working zone.

13. The applicator pad of claim 12 wherein said resilient cushion is a flexible polymeric foam.

14. The applicator pad of claim 12 wherein said exterior applying layer comprises a front edge portion, a rear edge portion and two side edge portions.

15. The applicator pad of claim 14 wherein said rear edge portion comprises at least a part of said second working zone.

16. The applicator pad of claim 15 wherein said front edge portion and said rear edge portion are sloped upward.

17. The applicator pad of claim 12 including means for attaching said applicator pad to a handle, said means being affixed to said resilient cushion.

18. The applicator pad of claim 12 additionally comprising a base affixed to said resilient cushion, said base including means for attaching said applicator pad to a handle.

19. The applicator pad of claim 12 wherein said first working zone is a fabric having a flocked pile.

20. The applicator pad of claim 12 wherein the effective height of said pile of said second working zone is at least as great as the height of said first set of generally erect bristle-like fibers.

21. The applicator pad of claim 12 wherein the effective height of said pile of said second working zone is slightly less than the height of said first set of generally erect bristle-like fibers.

22. The applicator pad of claim 12 wherein said pile of said first working zone additionally comprises a second set of generally erect bristle-like fibers which are shorter than and distributed among said fibers of said first set.

23. The applicator pad of claim 12 additionally comprising a flexible barrier layer interposed between and affixed to said cushion and said exterior applying layer.

24. The applicator pad of claim 23 wherein said flexible barrier layer is affixed to said cushion and said exterior applying layer by adhesive.

25. The applicator pad of claim 12 wherein said cover comprises a flexible barrier layer interposed between said cushion and said exterior applying layer.

26. The applicator pad of claim 25 wherein said flexible barrier layer is a layer of flexible adhesive.

27. The applicator pad of claim 25 wherein said flexible barrier layer comprises a flexible polymeric film.

28. The applicator pad of claim 12 wherein said exterior applying layer is affixed directly to said resilient cushion.

29. The applicator pad of claim 12 wherein said exterior applying layer is affixed to said resilient cushion by an adhesive.

30. A pad applicator comprising
a. a handle;
b. an exterior applying layer; and
c. a resilient cushion interposed between said handle and said exterior applying layer;
wherein
d. said exterior applying layer comprises
(1) a first working zone having a pile comprising ing a first set of generally erect bristle-like fibers, and
(2) a second working zone having a pile of soft, fleecy fibers;
e. the exterior surface of said first working zone constitutes from about 30 to about 95 percent of the total exterior surface area of said exterior applying layer;
f. the exterior surface of said second working zone constitutes from about 5 to about 70 percent of the total exterior surface area of said exterior applying layer; and
g. the rear one-third of said exterior applying layer contains at least half of said second working zone.

31. The pad applicator of claim 30 wherein at least a part of the exterior surface of said exterior applying layer is sloped upward.

32. The pad applicator of claim 30 wherein said exterior applying layer comprises a front edge portion, a rear edge portion and two side edge portions.

33. The pad applicator of claim 32 wherein said rear edge portion comprises at least a part of said second working zone.

34. The pad applicator of claim 33 wherein said front edge portion and said rear edge portion are sloped upward.

35. The pad applicator of claim 30 wherein said resilient cushion is a flexible polymeric foam.

36. The pad applicator of claim 30 wherein said first working zone is a fabric having a flocked pile.

37. The pad applicator of claim 30 wherein the effective height of said pile of said second working zone is at least as great as the height of said first set of generally erect bristle-like fibers.

38. The pad applicator of claim 30 wherein the effective height of said pile of said second working zone is slightly less than the height of said first set of generally erect bristle-like fibers.

39. The pad applicator of claim 30 wherein said pile of said first working zone additionally comprises a second set of generally erect bristle-like fibers which are shorter than and distributed among said fibers of said first set.

40. The pad applicator of claim 30 wherein said cover comprises a flexible barrier layer interposed between said cushion and said exterior applying layer.

41. The pad applicator of claim 40 wherein said flexible barrier layer is a layer of flexible adhesive.

42. The pad applicator of claim 40 wherein said flexible barrier layer comprises a flexible polymeric film.

43. The pad applicator of claim 30 wherein said exterior applying layer is affixed to said resilient cushion.

44. The pad applicator of claim 30 wherein said exterior applying layer is affixed to said resilient cushion by an adhesive.

45. The pad applicator of claim 30 wherein said resilient cushion is affixed to said handle by an adhesive.

46. The pad applicator of claim 30 wherein said resilient cushion is affixed to a base and wherein said base is affixed to said handle.

47. The pad applicator of claim 46 wherein said resilient cushion is affixed to said base by an adhesive.

48. The pad applicator of claim 46 wheren said base includes channels and said handle includes tongues and wherein said base is affixed to said handle by engagement of said tongues and said channels.

49. The pad applicator of claim 48 wherein said resilient cushion is affixed to said base by an adhesive.

* * * * *